United States Patent [19]

Lewis, Jr. et al.

[11] Patent Number: 5,048,124

[45] Date of Patent: Sep. 17, 1991

[54] EASY ACCESS PROTECTIVE COVERALLS

[75] Inventors: Milton A. Lewis, Jr., Richmond, Va.; Jeffrey S. Mason, Covington, Ind.; Carson B. Swinford, Danville, Ill.; Timothy R. Wiseman, Sr., Richmond, Va.

[73] Assignee: E. I. Du Pont de Nemours and Company, Wilmington, Del.

[21] Appl. No.: 414,484

[22] Filed: Sep. 29, 1989

[51] Int. Cl.[5] ..... A41D 13/00; A62B 17/00

[52] U.S. Cl. ..... 2/79; 2/2.5; 2/81; 2/82; 2/DIG. 7

[58] Field of Search ..... 2/79, 81, 2, 2.1 A, 2/84, 2.5, 69, 2.1 R, DIG. 7

[56] References Cited

U.S. PATENT DOCUMENTS

| | | | |
|---|---|---|---|
| 1,626,136 | 4/1927 | Hart . | |
| 1,795,775 | 3/1931 | Hart . | |
| 1,896,183 | 2/1933 | Manson . | |
| 2,573,414 | 10/1951 | Dunn | 2/81 |
| 3,164,840 | 1/1965 | Reynolds | 2/81 |
| 3,711,865 | 1/1973 | Schifman | 2/79 |
| 4,034,441 | 7/1977 | Ellis | 2/81 |
| 4,038,698 | 8/1977 | Smith | 2/79 |
| 4,242,769 | 1/1981 | Rayfield et al. | 9/330 |
| 4,272,851 | 6/1981 | Goldstein | 2/79 |
| 4,464,795 | 8/1984 | Long et al. | 2/2.1 R |
| 4,667,344 | 5/1987 | Cooper, III | 2/79 |
| 4,768,233 | 9/1988 | Grilliot | 2/81 |
| 4,816,330 | 3/1989 | Freund et al. | 2/2 |
| 4,829,603 | 5/1989 | Schnoor et al. | 2/79 |
| 4,831,664 | 5/1989 | Suda | 2/2 |
| 4,847,914 | 7/1989 | Suda | 2/84 |
| 4,864,654 | 9/1989 | Schriver et al. | 2/84 |

FOREIGN PATENT DOCUMENTS

| | | |
|---|---|---|
| 2929317 | 2/1981 | Fed. Rep. of Germany . |
| 2447157 | 9/1980 | France . |

OTHER PUBLICATIONS

U.S. Patent Application Ser. No. 07/366,711-Filed 6/15/89.

*Primary Examiner*—William A. Cuchlinski, Jr.
*Assistant Examiner*—William C. Dowling

[57] ABSTRACT

In accordance with the invention, protective coveralls are provided which are easy to put on and take off. The coveralls include a one-piece main suit with arm and leg portions connected to a torso portion having shoulder areas and a neck opening. The main suit includes a slit-like opening extending downwardly from the neck opening adjacent the uppermost area of one shoulder diagonally across the front of the torso portion to the opposite upper leg. A zipper is provided for closing the slit-like opening and an elongate flap is attached to the main suit along and adjacent to the zipper at one side of the opening to cover the zipper. Complementary hook and loop fastening tapes having a width at least 2 cm wide are used for securing the flap to the suit covering the zipper. The coveralls also have an unattached extension of the elongate flap which overlaps further over the opposite side of the opening with the unattached extension being unattached from the main suit along a predominant portion of its length. The unattached extension provides a hand grip to assist in gripping the flap to detach the complementary hook and loop fastening tapes securing the flap to the suit.

6 Claims, 4 Drawing Sheets

EASY ACCESS PROTECTIVE COVERALLS

BACKGROUND OF THE INVENTION

The present invention relates to garments for providing protection to the wearer in a hazardous environment and more particularly relates to protective coveralls which are easy to access.

Various types of protective coveralls are known for use in protecting the wearer of the coveralls from hazards including flame, hot and/or corrosive chemicals, molten metals, and the like. One such type of coveralls includes a one-piece suit for the body, arms and legs which has a central, usually zippered opening extending centrally down the front of the suit from the collar. A separate, removable headgear is worn together with the one-piece suit.

Such suits generally have a laminated construction with a durable outer shell which is intended to be impervious to the hazards to be encountered and a thermally insulative liner which increases the protection against high temperature conditions and which may also include additional barrier layers. The weight and bulkiness of the laminated construction, particularly in coveralls for protection under extreme conditions, makes difficult the task of putting on and taking off the suits. Often one, or even two persons are necessary to assist the wearer in getting into and out of known protective suits.

SUMMARY OF THE INVENTION

In accordance with the invention, there is provided a protective coveralls providing protection to a wearer of the coveralls in a hazardous environment which are easy to put on and take off. The coveralls include a one-piece main suit with arm and leg portions connected to a torso portion having shoulder areas and a neck opening. The protective coverall also includes a detachable head covering including a viewing lens and a downwardly-draping hood for covering the head of the wearer and extending downwardly at least over the neck opening of the main suit in use. The main suit includes a slit-like opening extending downwardly from the neck opening adjacent the uppermost area of one shoulder area diagonally across the front of the torso portion to a position adjacent the upper area of the opposite leg portion. A zipper is provided for closing the slit-like opening. An elongate flap is attached to the coveralls along and adjacent to the zipper at one side of the opening with the flap having a length at least as long as the opening and a width sufficient to cover the zipper and provide an overlapping portion which overlaps the main suit on the opposite side of the opening. Complementary hook and loop fastening tapes having a width at least 2 cm wide on the underside of the overlapping portion of the flap and on a corresponding location on the exterior of the main suit are used for securing the flap to the suit covering the zipper. In the coveralls of the invention, the hook and loop fastening tapes are generally continuous and extending substantially the entire length of the flap. The coveralls also have an unattached extension of the elongate flap which overlaps further over the opposite side of the opening with the unattached extension being unattached from the main suit along a predominant portion of its length. The unattached extension thereby provides a hand grip to assist in gripping the flap to detach the complementary hook and loop fastening tapes securing the flap to the suit.

BRIEF DESCRIPTION OF THE DRAWINGS

The invention and its advantages may be understood by reference to the following detailed description when read in conjunction with the accompanying drawings in which.

DETAILED DESCRIPTION

Figure 1:
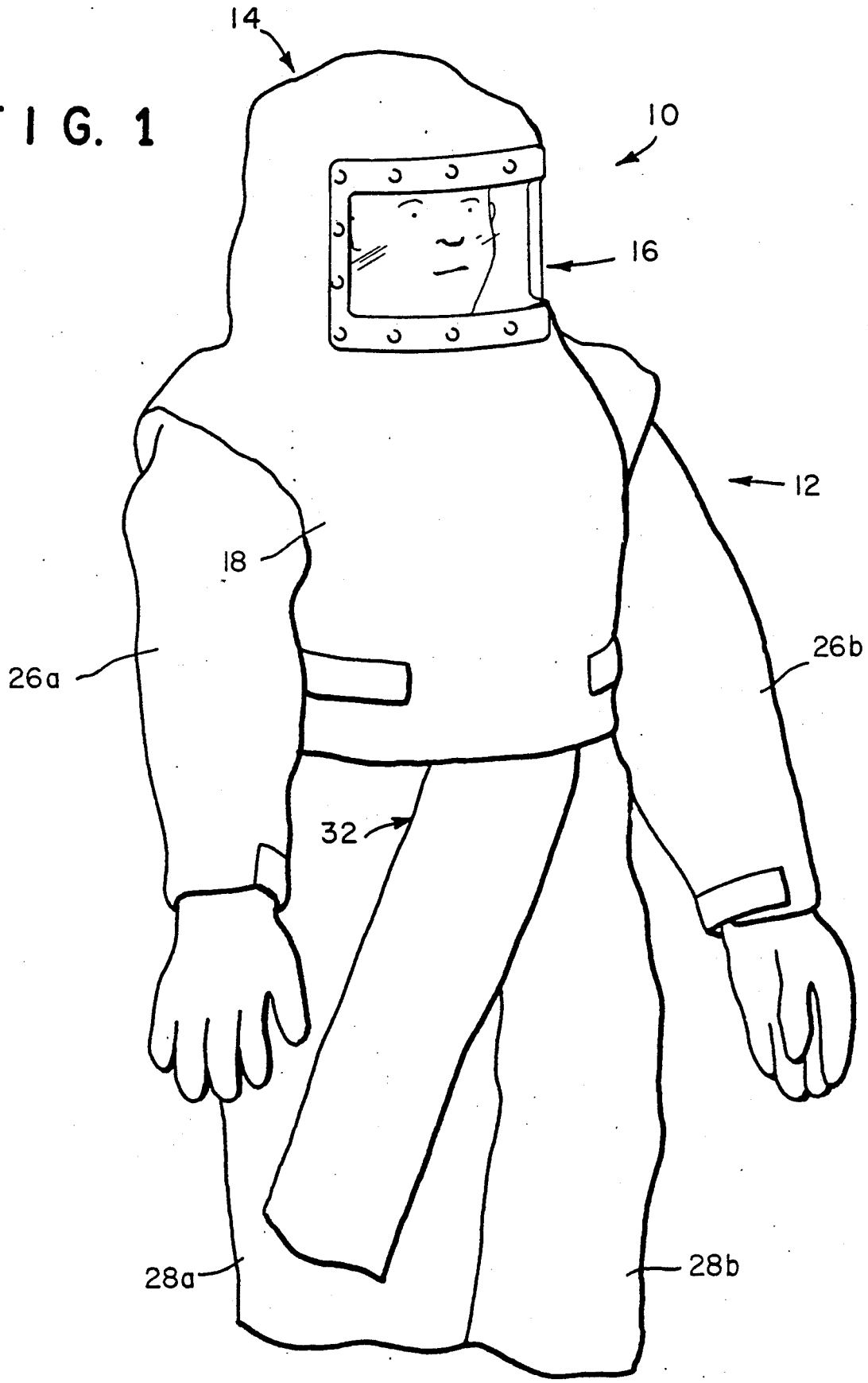
FIG. 1 is a somewhat diagrammatical perspective view of a preferred embodiment of coveralls in accordance with the present invention.

Referring now to the drawings in which like reference characters designate like or corresponding parts throughout the several views, protective coveralls 10 are shown in FIG. 1 which embody a preferred form of the present invention. The protective coveralls 10 include a main suit 12 and a removable headgear 14. The headgear 14 includes a viewing lens 16 and a downwardly draping hood 18 for covering the head of the wearer of the coveralls 10 and which covers the upper areas of the main suit 12 in use.

The coveralls 10 depicted are intended to represent coveralls which have any of a variety of laminated constructions for protection against hazards including steam, flame, and hot and or corrosive chemicals which include a durable, usually liquid impervious outer shell and a thermal insulative inner liner which may include other barrier layers. The laminated construction is employed for most portions of the coveralls although the unlined shell may comprise portions of the suit which are not in contact with the body such as the hood 18. A suitable shell for the protection against hazards such as high temperatures or steam is a woven aramid fabric such as a fabric woven from poly(paraphenylene terephthalamide) which has been laminated to a liquid impervious layer such as an aluminum film-poly(ethylene terephthalate) film laminate. A suitable liner is a multilayer laminate including at least a layer of woven poly(metaphenylene isophthalamide) and a nonwoven layer such as one or more layers of spun-laced fabrics of poly(paraphenylene terephthalamide).

Figure 2:
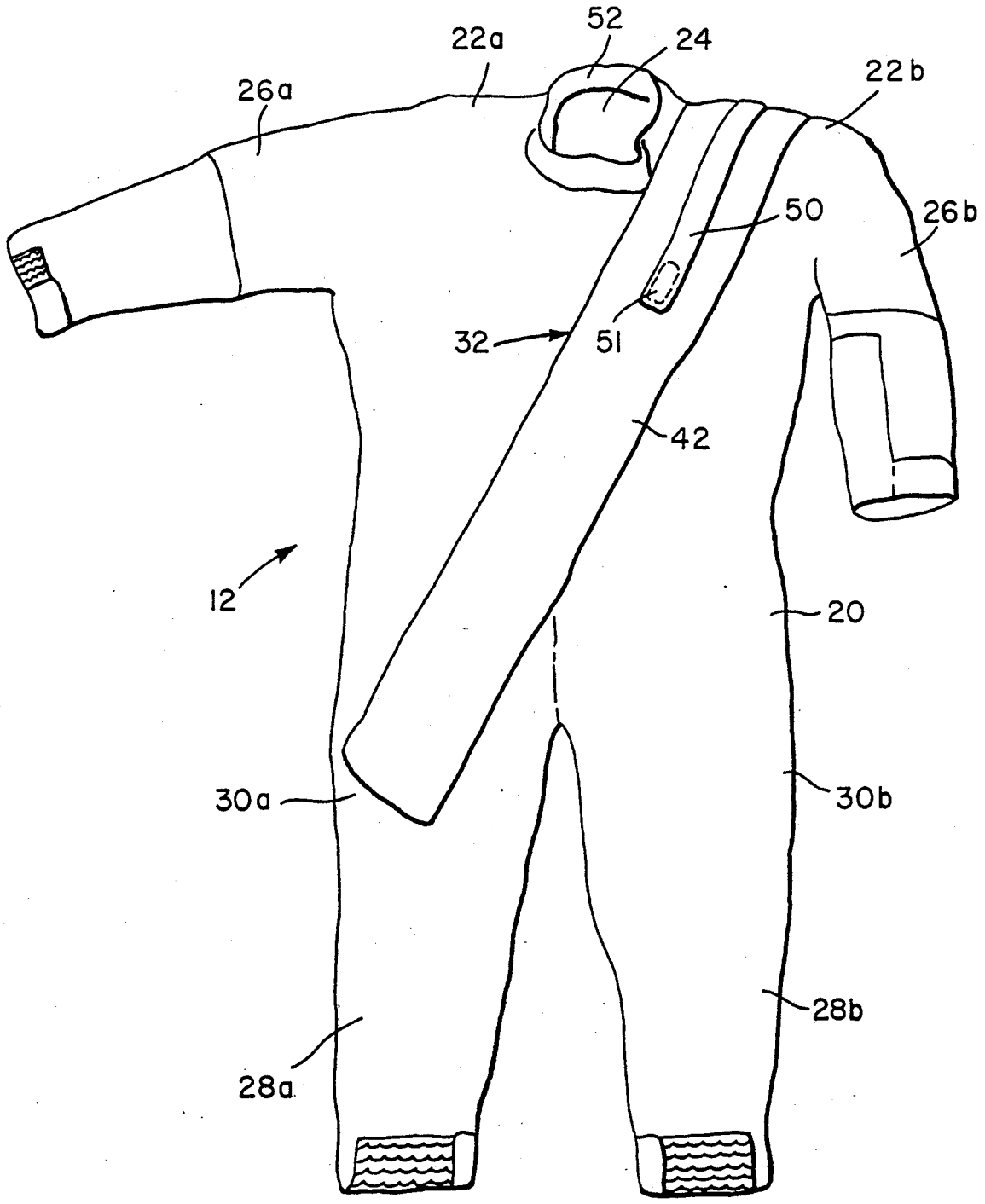
FIG. 2 is a perspective view of a main suit forming a portion of the coveralls illustrated in FIG. 1.

Referring to FIG. 2, the main suit 12 of the coveralls includes a torso portion 20 including right and left shoulder areas, 22*a* and 22*b*, respectively, and neck opening 24. Right and left arm and leg portions, 26*a* and 26 *b*, respectively and 28*a* and 28*b*, respectively, are connected to the one piece main suit. The leg portions 28*a* and 28*b* attach to the torso portion 20 at right and left upper leg areas, 30*a* and 30*b*, respectively.

Figure 3:
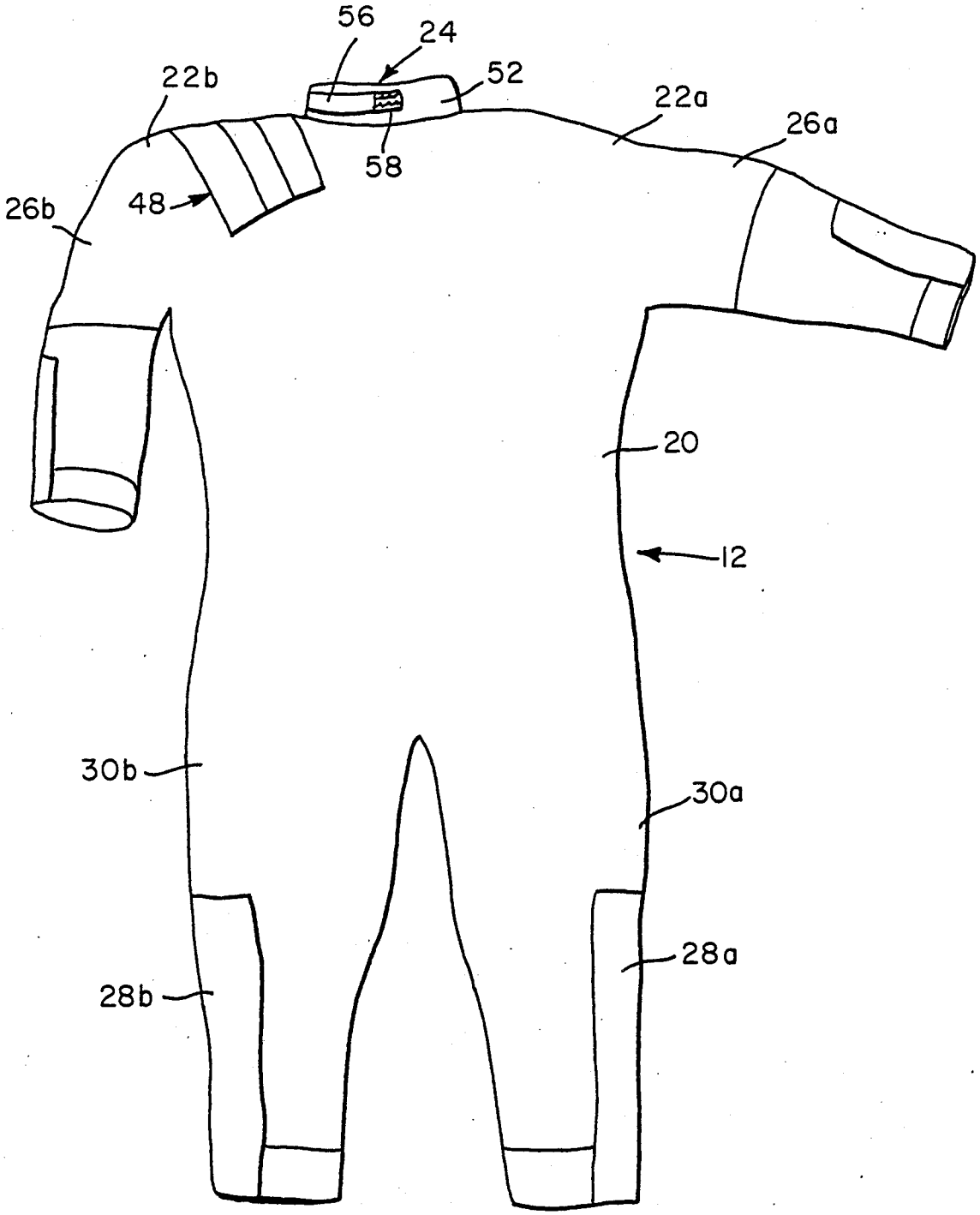
FIG. 3 is a perspective view of the back of main suit of FIG. 2.
Figure 4:
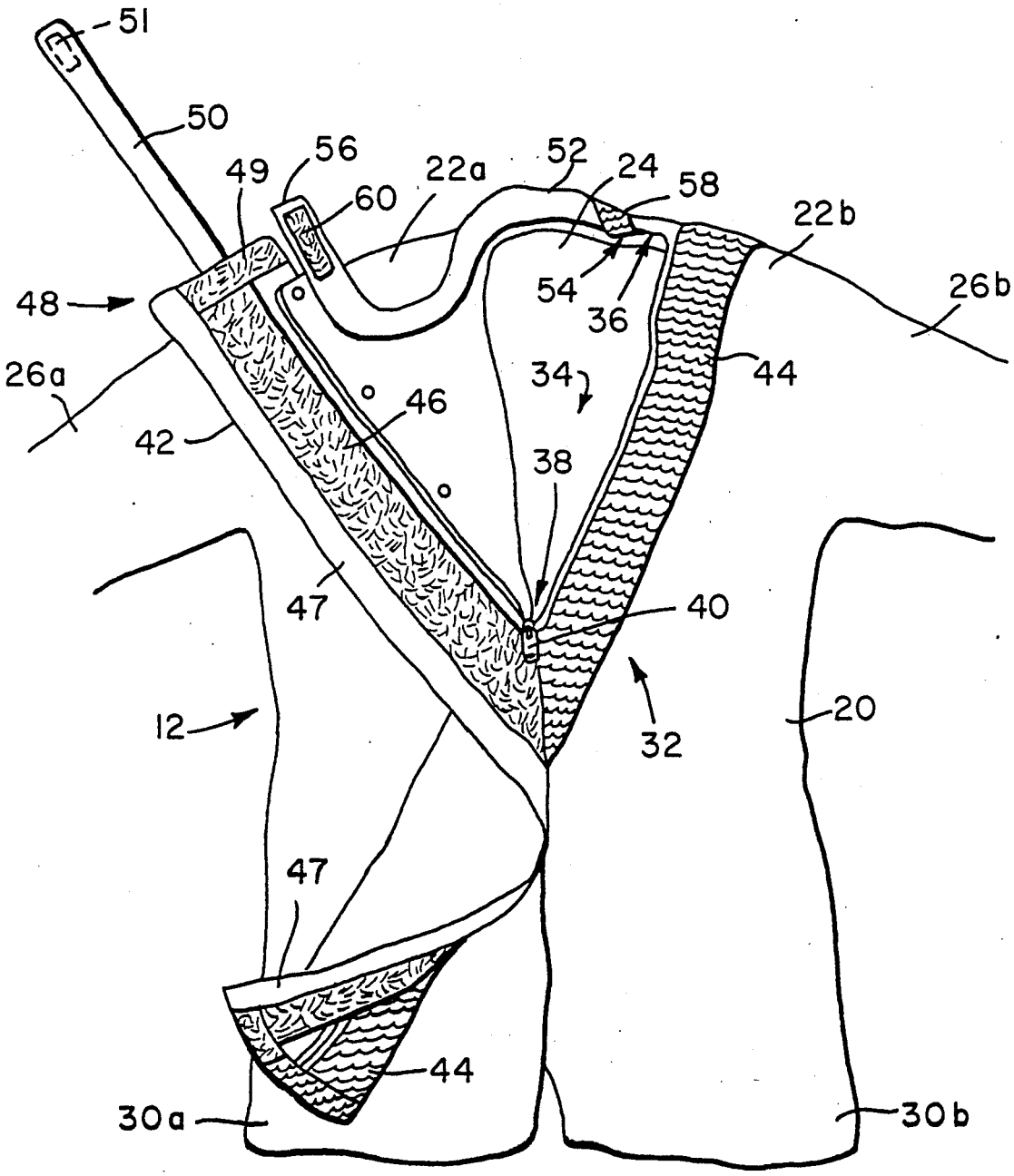
FIG. 4 is a partial view of the main suit of FIG. 2 with a closure of the main suit shown in a partially open configuration.

Referring now to FIGS. 2, 3 and 4, a main closure 32 is provided in the main suit 12 for providing access into the suit. The main closure 32 includes a slit-like opening 34 which, in the suit depicted, extends downwardly from the neck opening 24 adjacent the uppermost area of the left shoulder area 22*b* and which extends diagonally across the front of the torso portion 20 to a position adjacent the upper area 30*a* of the opposite leg portion which is the right leg portion 28*a*. An alternate construction would be for the opening 34 to extend from the right shoulder 22a to the upper leg area 30b of the left leg 28b. In the preferred embodiment of the coveralls 10 illustrated, the slit-like opening includes a first slit 36 which extends from the neck opening 24 a short distance along the uppermost portion of the shoulder area 22b to a position on the shoulder spaced-apart from the neck opening 24. Preferably, the first slit has a length of between about 3 cm to about 8 centimeters. A second slit 38 provides most of the slit-like opening 34 and preferably is generally linear. The second slit 38 extends downwardly preferably at an angle of between about 10 degrees and about 20 degrees from vertical to a position adjacent the outer side of the upper arm 30a of the leg. Preferably, the second slit extends down the upper leg area 30a by a distance of about 10 centimeters to about 50 centimeters, most preferably 25 centimeters to about 40 centimeters measured from the approximate location of where the hip of the wearer will be found in the suit. The second slit 38 is closable by means of a zipper 40 which extends from the bottom of the second slit 38 and is advanced upwardly to close the opening 34 all the way to the uppermost portion of the second slit 38 at which the second slit joins the first slit 36.

Referring still to FIGS. 2, 3 and 4, the slit-like opening 34 is covered by an elongate flap 42. The elongate flap 42 is attached to the main suit 12 along and adjacent to the zipper 40 at one side of the opening with the flap 42 having a length at least as long as the opening 34 and a width sufficient to cover the zipper 40 and still provide an overlapping portion which overlaps the suit on the opposite side of the opening. The elongate flap 42 can be of the same material as the outer shell of the main suit 12 and thus provides protection and prevents the entry of hazardous materials through the zipper 40.

The elongate flap 42 is permanently attached on one side of the zipper 40 such as by sewing but is removable from the opposite side of the zipper since it is secured by means of complementary hook pile and and loop pile fastening tapes, 44 and 46, respectively, such as those sold under the trademark VELCRO®. In order to minimize the chances of the flap 42 coming open and exposing the exterior of the zipper during a chemical spill or steam leak, the hook and loop fastening tapes have a width at least 2 centimeters wide and run generally continuously along substantially the entire length of the flap 42. In the embodiment depicted, the loop pile portion 46 is attached to the underside of the overlapping portion of the flap 42 and the hook portion 44 is attached on a corresponding location on the exterior of the main suit.

As illustrated in FIG. 4, the flap is provided with an unattached extension 47 which overlaps further over the opposite side of the opening 34 over the zipper with the unattached extension being unattached from the main suit along at least a predominant portion of, and preferably all along of its length. In the embodiment depicted, the unattached extension 47 of the flap 42 is provided by making the flap wider than the hook and loop portions of the complimentary hook and loop fabric tapes 44 and 46. Preferably, the unattached extension 47 of the flap is at least about 3 centimeters wide and preferably is between about 3 cm and about 6 centimeters wide. The unattached extension 47 provides a hand grip along the entire length of the flap 42 to assist in gripping the flap and disengage the loop portion 46 from the hook portion 44 of the fastening tapes which have considerable securing strength due to their large width.

Referring now with particularity to FIG. 3, it is shown that the elongate flap 42 preferably extends up over the shoulder area 22b and covers the first slit 36 and extends past the the end of the second slit, most preferably by a distance of between about 5 cm and 20 cm. The risk of entry of materials through the uppermost portion of the opening 34 and zipper 40 is thereby decreased. In order to facilitate access into the suit, the "over-the-shoulder" extension 48 of the elongate flap 42 is wholly detachable from the back of the suit 12 so that it can be lifted away from the shoulder 22b as shown in FIG. 4. Additional hook and loop fabric tapes, the loop portion 49 being shown in FIG. 4, are used to secure the over-the-shoulder extension 48 of the elongate flap 42 to the back of the suit 12 as shown in FIG. 3.

To assist in pulling the over-the-shoulder extension 48 of the elongate flap 42 from the back of the suit 12 to take the suit off, a strap 50 is provided which can be grasped by the wearer to loosen the over-the-shoulder extension 48 of the flap 42 without assistance from others. When the coveralls 10 are being worn, the strap 50 is securable to the outside of the flap 42 by suitable means such as complementary hook and loop pile tapes, the location of which in the coveralls depicted being identified by the dotted lines identified by the numeral 51 (see FIG. 2).

The main suit 12 optionally includes a collar 52 which extends the neck opening 24 upwardly about the neck of the wearer in use. In the coveralls illustrated, a slit 54 is provided in the collar 52 which joins the first slit 36. The collar 52 is closed by a strap 56 which overlaps the collar slit 54 and is secured by complimentary hook and loop pile fastening tapes 58 and 60, respectively.

In use, the depicted protective coveralls 10 in accordance with the invention are donned by a wearer by opening the main closure 32 of the main suit 12 and then entering the suit by pulling the leg portions 28a and 28b about the legs, inserting the right arm in the suit and then inserting the left arm. The zipper 40 is then pulled upwardly to the end of the second slit 38. The elongate flap 42 is then secured using the hook and loop fabric tapes along entire length of the flap, including securing the over-the-shoulder extension, 48, to the back of the main suit 12. The collar 52 (if present) is then closed by securing the collar strap 56 with the hook and loop pile fastening tapes 58 and 60. The headgear 14 is then placed on the wearer's head and appropriately secured.

To take the suit off after removing the headgear, the procedure is reversed with the removal strap 50 used to pull the over-the-shoulder extension loose from its position on the back of the suit. The unattached extension 47 of the elongate flap 42 is used as a hand grip to detach the elongate flap 42 from its position covering the zipper 40. The zipper 40 is then opened. With the zipper fully opened, the left shoulder of the suit depicted drops easily off the shoulder of the wearer and then the wearer can shift the upper portion of the main suit 12 towards the right to pull his right arm out and the step out of the suit.

The suit in accordance with the invention is easy to take off and put on due to the position of the main closure and other features. The elongate flap covering the zipper and having the hook and loop fastening tapes being at least 2 centimeters wide provides extremely secure attachments to the flap increasing the degree of protection afforded by the suit. The over-the-shoulder extension 48 increases the protection against leakage into the upper portions of the zipper. Nevertheless, the suit is still easy to access due to the handgrip provided by the unattached extension 47 of the elongate flap and the removal strap 50 for disengaging the over-the-shoulder extension. Easy access is provided in the coveralls in accordance with the invention even when the combined weight the outer shell and inner liner are extremely heavy to provide protection under extreme conditions.

While a preferred embodiment has been shown and described in the foregoing detailed description, it will be understood that the invention is capable of numerous modifications, rearrangements and substitution of parts without departing from the spirit of the invention as set forth in the appended claims.

We claim:

1. Protective coveralls providing protection to a wearer of the coveralls in a hazardous environment comprising:

a one-piece main suit with arm and leg portions connected to a torso portion having shoulder areas and a neck opening;

a head covering including a viewing lens and downwardly-draping hood for covering the head of the wearer and extending downwardly at least over the neck opening of said main suit in use, said head covering being detachable from said main suit;

a slit-like opening extending downwardly from the neck opening adjacent the uppermost area of one shoulder area diagonally across the front of said torso portion to a position adjacent the upper area of the opposite leg portion;

a zipper for closing said slit-like opening;

an elongate flap attached to said main suit along and adjacent to the zipper at one side of said opening, said flap having a length at least as long as said slit-like opening and a width sufficient to cover the zipper and provide an overlapping portion which overlaps the main suit on the opposite side of the opening;

complementary hook and loop fastening tapes having a width at least 2 cm wide on the underside of said overlapping portion of said flap and on a corresponding location on the exterior of said main suit for securing said flap to said suit covering said zipper, said hook and loop fastening tapes being generally continuous and extending substantially the entire length of said flap;

an unattached extension of said elongate flap which overlaps further over said opposite side of said opening, said unattached extension being unattached from said main suit along at least a predominant portion of its length whereby said unattached extension provides a hand grip to assist in gripping said flap to detach said complementary hook and loop fastening tapes securing said flap to said suit; and an over-the-shoulder extension of the uppermost area of said flap which extends past and over the uppermost area of said shoulder area of said main suit.

2. The protective coveralls of claim 1 wherein said over-the-shoulder extension of said flap is wholly detachable from the back of the main suit with complementary hook and loop fastening tapes being provided to secure said over-the-shoulder extension to the upper area of the back of said main suit.

3. The protective coveralls of claim 1 wherein said over-the-extension of said flap extends between about 5 and about 20 cm past the end of the slit-like opening.

4. The protective coveralls of claim 2 further comprising a strap attached to the said over-the-shoulder extension of said flap to assist in detaching said over-the-extension from the back of the suit.

5. The protective suit of claim 1 wherein said slit-like opening comprises a first slit which extends toward the arm from the side of said neck opening along the uppermost area of the shoulder area to a position spaced-apart from said neck opening and a second slit which extends from said position to the opposite upper leg area, said zipper closing said second slit.

6. The protective coveralls of claim 4 wherein said first slit has a length of between about 3 cm to about 8 cm.

* * * * *

UNITED STATES PATENT OFFICE

CERTIFICATE OF CORRECTION

PATENT NO. : 5,048,124

DATED : September 17, 1991

INVENTOR(S) : Milton A. Lewis, Jr.; Jeffrey S. Mason; Carson B. Swinford; and Timothy R. Wiseman, Sr.

It is certified that error appears in the above-identified patent and that said Letters Patent is hereby corrected as shown below:

On the title page, next to the Assignee reference numeral [73], the assignee "E. I. Du Pont de Nemours and Company, Wilmington, Del." should read-- E. I. Du Pont de Nemours and Company, Wilmington, Del. and Steel Grip, Inc., Danville, Ill.--

Signed and Sealed this

Twelfth Day of January, 1993

*Attest:*

DOUGLAS B. COMER

*Attesting Officer*

*Acting Commissioner of Patents and Trademarks*